US008718531B2

(12) United States Patent
Ichikawa et al.

(10) Patent No.: US 8,718,531 B2
(45) Date of Patent: May 6, 2014

(54) CLEANING APPARATUS HAVING DAMPING UNIT TO REGULATE VIBRATION

(75) Inventors: Yuzo Ichikawa, Kanagawa (JP); Akiko Kimura, Kanagawa (JP); Tomoya Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 329 days.

(21) Appl. No.: 13/091,795

(22) Filed: Apr. 21, 2011

(65) Prior Publication Data

US 2012/0114404 A1 May 10, 2012

(30) Foreign Application Priority Data

Nov. 4, 2010 (JP) ..... 2010-247695

(51) Int. Cl.
*G03G 21/00* (2006.01)

(52) U.S. Cl.
USPC ..... 399/351

(58) Field of Classification Search
USPC ..... 399/350, 351
See application file for complete search history.

(56) References Cited

U.S. PATENT DOCUMENTS

| | | | | |
|---|---|---|---|---|
| 4,152,067 | A * | 5/1979 | Kubota | 399/351 |
| 4,576,468 | A * | 3/1986 | Saito | 399/351 |
| 5,608,509 | A * | 3/1997 | Shirai et al. | 399/351 |
| 5,659,865 | A * | 8/1997 | Zarbo | 399/327 |
| 6,836,639 | B2 * | 12/2004 | Karakama et al. | 399/351 |
| 2002/0127036 | A1 * | 9/2002 | Sato et al. | 399/350 |
| 2010/0247189 | A1 * | 9/2010 | Akamatsu et al. | 399/350 |
| 2011/0052288 | A1 * | 3/2011 | Koido | 399/351 |
| 2012/0076559 | A1 * | 3/2012 | Kimura et al. | 399/351 |

FOREIGN PATENT DOCUMENTS

| | | | | |
|---|---|---|---|---|
| JP | 60012572 | A * | 1/1985 | G03G 21/00 |
| JP | 08-166751 | A | 6/1996 | |
| JP | 2003-084637 | A | 3/2003 | |
| JP | 2009-294355 | A | 12/2009 | |

* cited by examiner

*Primary Examiner* — G. M. Hyder
(74) *Attorney, Agent, or Firm* — Sughrue Mion, PLLC

(57) ABSTRACT

A cleaner includes a cleaning member that includes a tip portion that comes into contact with an image carrier that carries an image, and that removes and cleans developer adhered to the image carrier, a cleaning container which stores the developer removed by the cleaning member, a cleaning support that includes a cleaning supporting portion that supports a proximal end of the cleaning member, and a damped portion, a damping body that includes a first and a second damping bodies arranged in contact with the damped portion and that regulates vibration of the cleaning support, and a fixing member of the damping body that includes a first fixing portion arranged to face the damped portion with the first damping body, and a second fixing portion arranged to face the damped portion with the second damping body, and that is supported by the cleaning container.

9 Claims, 15 Drawing Sheets

2
26a
26f
32a
21d
26e
26d
32
26c
31
16a
16
14
22
13
21
12
31a
46
Z
X
Y
(-X)
(-Y)
(-Z)

CLEANING APPARATUS HAVING DAMPING UNIT TO REGULATE VIBRATION

CROSS-REFERENCE TO RELATED APPLICATION

This application is based on and claims priority under 35 USC 119 from Japanese Patent Application No. 2010-247695 filed on Nov. 4, 2010.

BACKGROUND

Technical Field

The present invention relates to a cleaner, an image forming apparatus and a cleaning apparatus.

SUMMARY

In order to address the above technical subject, according to an aspect of the invention, there is provided a cleaner including:

a plate-shaped cleaning member that includes a tip portion that comes into contact with an image carrier that carries an image on a surface thereof, and that removes and cleans developer adhered to the surface of the image carrier;

a cleaning container which stores the developer removed by the cleaning member;

a cleaning support that includes a cleaning supporting portion that supports a proximal end of the cleaning member, and a plate-shaped damped portion;

a damping body that includes a first damping body arranged in contact with one face of the damped portion, and a second damping body arranged in contact with the other face of the damped portion and that regulates vibration of the cleaning support; and a fixing member of the damping body that includes a first fixing portion arranged to face one face of the damped portion with the first damping body interposed therebetween, and a second fixing portion arranged to face the other face of the damped portion with the second damping body interposed therebetween, and that is supported by the cleaning container.

BRIEF DESCRIPTION OF THE DRAWINGS

Exemplary embodiments of the present invention will be described in detail based on the following figures, wherein:

FIG. 5A is a perspective view of the first fixing member, and FIG. 5B is an explanatory view of a state where a first damping member has been supported by the first fixing member;

FIG. 7A is a perspective view of the cleaning support, and FIG. 7B is an explanatory view of a state where a cleaning member and a second damping member have been supported by the cleaning support;

FIG. 8A is an explanatory view of a state where the damping member has been brought into contact with the cleaning support in a shrunken state, and FIG. 8B is an explanatory view of a state where the cleaning support has been deflected by the elastic force of the damping member;

FIG. 13A is an overall view of the cleaner, and FIG. 13B is an enlarged view of principal parts of a damping rubber portion;

FIG. 14A is an explanatory view of principal parts of Example 4, and FIG. 14B is an explanatory view of principal parts of Example 5; FIG. 15A is an explanatory view of principal parts of Example 6, FIG. 15B is an explanatory view of principal parts of Example 7, and FIG. 15C is an explanatory view of principal parts of Example 8, and FIG. 15D is an explanatory view of principal parts of Example 9.

DETAILED DESCRIPTION

Figure 1:
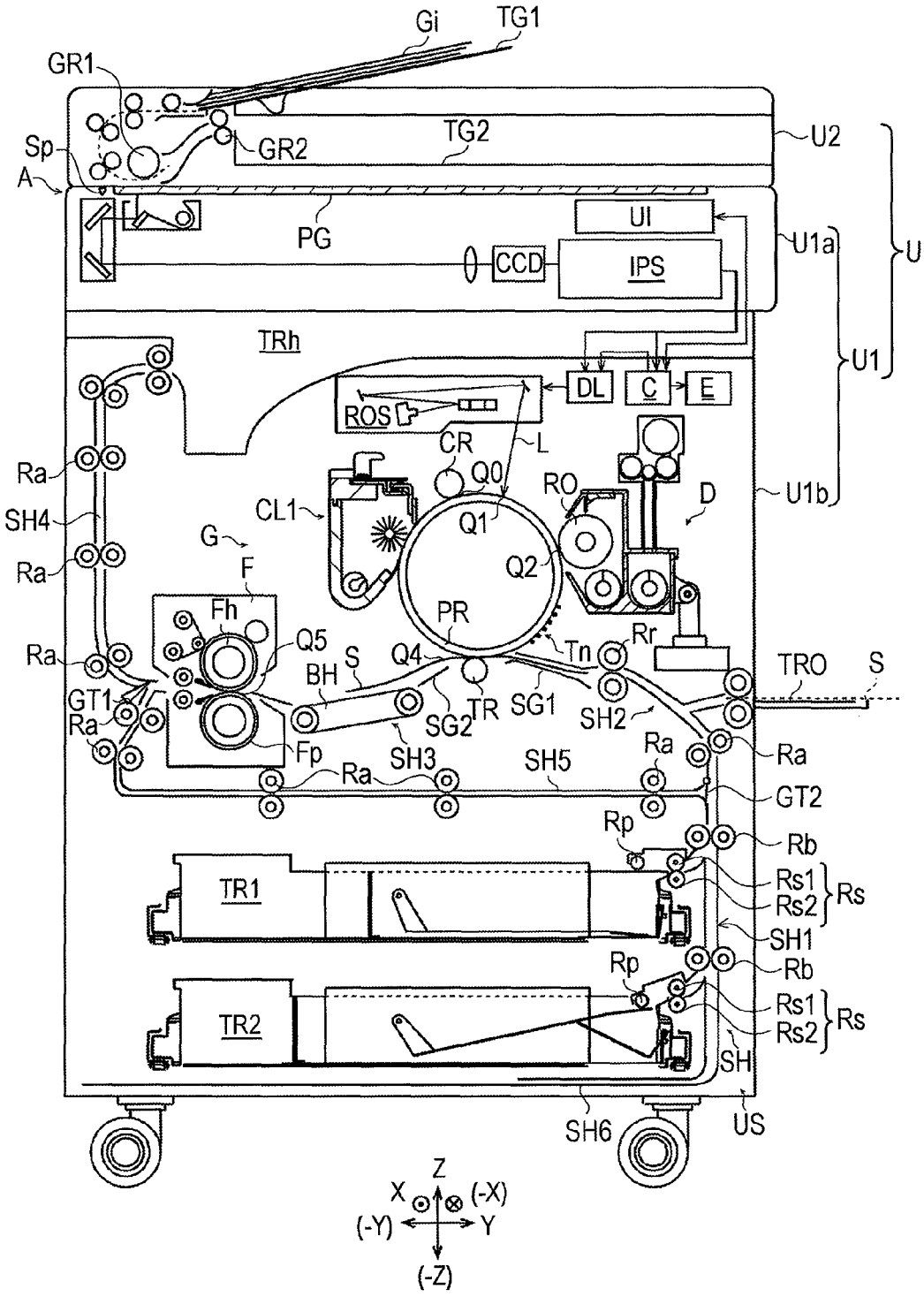
FIG. 1 is an explanatory view of an overall image forming apparatus of Example 1 of the invention.

Next, although specific examples (hereinafter referred to as examples) of an exemplary embodiment of the invention will be described referring to the drawings, the invention is not limited to the following examples.

In order to make the invention more easily understandable, in the drawings, the front-and-rear direction is defined as an X-axis direction, the right-and-left direction is defined as a Y-axis direction, and the up-and-down direction is defined as a Z-axis direction.

In addition, directions or sides shown by arrows X, −X, Y, −Y, Z, and −Z are defined as a front direction, a rear direction, a right direction, a left direction, an up direction, and a down direction, respectively, or are defined as front side, rear side, right side, left side, upper side, and lower side, respectively.

Additionally, in the drawings, a symbol in which "." is drawn in an "O" means an arrow that points to the front of a sheet from the back thereof, and a symbol in which "X" is drawn in an "O" means an arrow that points to the back of the sheet from the front thereof.

In addition, in the following description using the drawings, illustration of those other than members required for description is appropriately omitted to facilitate understanding.

EXAMPLE 1

FIG. 1 is an explanatory view of an overall image forming apparatus of Example 1 of the invention.

In FIG. 1, an image forming apparatus U includes a main body U1 of a digital copying machine serving as an example of a main body of the image forming apparatus that has a transparent document table PG, commonly called a platen glass PG, on the top face thereof, and a document conveying device U2 supported on the platen glass PG.

The document conveying device U2 has a document feed tray TG1 serving as an example of a document feed section in which plural documents Gi to be copied are stacked and received. Each of the plural documents Gi loaded on the document feed tray TG1 sequentially passes through a copying position on the platen glass PG, i.e., a contact position of a platen roller GR1 serving as an example of a document conveying member, and is ejected to a document ejection tray TG2 serving as an example of a document ejection section by a document ejection member GR2.

The main body U1 of the copying machine has a scanner section U1*a* serving as an example of an image reading device that has the platen glass PG and a printer section U1*b* serving as an example of an image recording device.

The scanner section U1*a* has a position detecting member, commonly called an exposure system registration sensor Sp, of an exposure system arranged at a reference position for reading, and an exposure optical system A.

The exposure optical system A is controlled in terms of movement and stopping by a detection signal of the exposure system registration sensor Sp, and is always stopped at a reading reference position shown in FIG. 1.

In the automatic conveyance operation that performs copying using the document conveying device U2, the exposure optical system A exposes each document Gi that passes through the copying position on the platen glass PG sequentially, in the state of being stopped at the reading reference position.

In the manual reading operation in which an operator places a document Gi on the platen glass PG with his/her hand to perform copying, the exposure optical system A exposes and scans the document Gi on the platen glass PG while moving to the right.

The reflected light from the exposed document Gi is converged on an imaging unit CCD through the exposure optical system A. The imaging unit CCD converts the reflected light from the document converged on the imaging surface thereof to an electrical signal.

An image processing unit IPS converts the read image signal input from the imaging unit CCD into a digital image write-in signal, and outputs the write-in signal to a write-in drive circuit DL of printer section U1*b*.

The write-in drive circuit DL whose operation timing is controlled by a control unit C of the printer section U1*b* outputs a driving signal according to the input image data to a latent image write-in device ROS.

A photoreceptor PR serving as an example of a rotating image carrier is arranged below the latent image write-in device ROS. After the surface of the photoreceptor PR is charged by a charging roller CR serving as an example of a charger in a charging region Q0, the surface is exposed and scanned at a latent image write-in position Q1 by a laser beam L serving as an example of latent image write-in light of the latent image write-in device ROS, and thereby, an electrostatic latent image is formed. The surface of the photoreceptor PR on which the electrostatic latent image has been formed rotates to move, and passes through a developing region Q2 and a transfer region Q4 sequentially.

The developing device D that develops the electrostatic latent image in the developing region Q2 conveys a developer to the developing region Q2 by a developing roller R0, and develops the electrostatic latent image on the surface of the photoreceptor PR that passes through the developing region Q2, as a toner image Tn serving as an example of a visible image.

A transfer roller TR serving as an example of a transfer unit that faces the photoreceptor PR in the transfer region Q4 is a member that transfers the toner image Tn on the surface of the photoreceptor PR to a sheet S serving as an example of a medium, and a transfer voltage of charging polarity and reversed polarity of a toner for development used by a developing device D is supplied from a power circuit E. The power circuit E that has applied voltages, such as a charging voltage applied to the charging roller CR, a developing voltage applied to the developing roller R0, and a transfer voltage applied to the transfer roller TR, a heater power source that heats a heater of a heating roller of a fixing device F as will be described below, or the like is controlled by the control unit C.

A first sheet feed tray TR1 and a second sheet feed tray TR2 serving as an example of a sheet feed container are arranged in line vertically at the lower portion of the main body U1 of the copying machine.

A pickup roller Rp serving as an example of a take-out member for a medium is arranged at an upper end of a right end of each sheet feed tray TR2, and a sheet S taken out by the pickup roller Rp is conveyed to a handling member Rs.

The handling member Rs has a feed roller Rs1 serving as an example of sheet feed members that are brought into contact with each other, and a retard roller Rs2 serving as an example of a separation member. The sheets conveyed to the handling member Rs are separated one by one, and are conveyed to a sheet conveying path SH1 serving as an example of a medium conveying path.

A conveying roller Rb serving as an example of a conveying member capable of rotating normally and reversely is arranged on the sheet conveying path SH1. The sheet S conveyed to the sheet conveying path SH1 is conveyed to an upper sheet conveying path SH2 before transfer by the conveying roller Rb capable of rotating normally and reversely.

The sheet S conveyed to the sheet conveying path SH2 before transfer is conveyed to a registration roller Rr, serving as an example of an adjusting member for timing at which the sheet is conveyed to the transfer region Q4, by the conveying roller Ra.

Additionally, the sheet S fed from a manual feed tray TR0 serving as an example of a manual feed section is also conveyed to the registration roller Rr.

The sheet S conveyed to the registration roller Rr is guided by a sheet guide SG1 before transfer serving as an example of a medium guide member before transfer, in accordance with the timing when the toner image Tn on the surface of the photoreceptor PR moves to the transfer region Q4, and is conveyed to the transfer region Q4.

The toner image Tn developed on the surface of the photoreceptor PR is transferred to the sheet S by the transfer roller TR, in the transfer region Q4. After the transfer, the surface of the photoreceptor PR is cleaned by a cleaner CL1 serving as an example of a cleaner to remove residual toner serving as an example of extraneous matter to be removed, and is charged again by the charging roller CR.

A toner image forming device G serving as an example of a visible image forming device is constituted by the photoreceptor PR, the charging roller CR, the latent image write-in device ROS, the developing device D, and the like. Additionally, in Example 1, the photoreceptor PR and the cleaner CL1 are constituted as an image carrier unit PR+CL1, commonly called a process cartridge, that is integrally attachable, detachable, and replaceable with respect to the image forming apparatus U.

A sheet conveying path SH3 after transfer serving as an example of a conveying path that conveys the sheet S on which the toner image Tn has been transferred in the transfer region Q4 to a fixing region Q5 is provided on the downstream side of the transfer region Q4 in the sheet conveying direction. The sheet S on which a toner image has been transferred by the transfer roller TR in the transfer region Q4 is peeled off from the surface of the photoreceptor PR, is guided by a sheet guide SG2 serving as an example of a medium guide member after transfer arranged on the sheet conveying path SH3 after transfer, and is conveyed to the fixing device F by a conveying belt BH serving as an example of a medium conveying member after transfer.

The fixing device F has a heating roller Fh serving as an example of a heating and fixing member that has a heater serving as a heat source therein, and a pressure roller Fp serving as an example of a pressurizing and fixing member. The sheet S conveyed to the fixing device F has a toner image heated and fixed thereon when passing through the fixing region Q5 constituted by a contact region between the heating roller Fh and the pressure roller Fp, and is then conveyed through an ejection passage SH4 serving as an example of a conveying path to a sheet ejection tray TRh serving as an example of a medium ejection section.

A switching gate GT1 serving as an example of switching member of a conveying path is arranged on the downstream side of the fixing device F on the sheet ejection passage SH4. The switching gate GT1 switches the conveying direction of the sheet S, which has passed through the fixing device F, to the direction of either the sheet ejection tray TRh or a connecting path SH5. The connecting path SH5 connects an upstream end of the ejection passage SH4, i.e., a downstream portion of the fixing device F, and the sheet conveying path SH1.

In double-side copying, the one-side recorded sheet S on a first side of which a toner image has been recorded is conveyed to the connecting path SH5 by the switching gate GT1, passes through a gate GT2 serving as an example of a regulating member in the conveying direction, and is conveyed to a reversing path SH6 serving as an example of a conveying path by the reverse rotation of the conveying roller Rb capable of rotating normally and reversely. The sheet S conveyed to the reversing path SH6 is conveyed in a reverse direction, that is, fed back, by the normal rotation of the conveying roller Rb capable of rotating normally and reversely, and is resent to the transfer region Q4 in a state where the front and back of the sheet are reversed.

A sheet conveying path SH serving as an example of a medium conveying path is constituted by elements designated by reference numerals SH1 to SH6.

A sheet conveying device US serving as an example of a medium conveying device is constituted by the conveying path SH and the rollers Ra, Rb, Rr, and the like that are arranged on the conveying path SH and have a sheet conveying function.

(Description of Cleaner)

Figure 2:
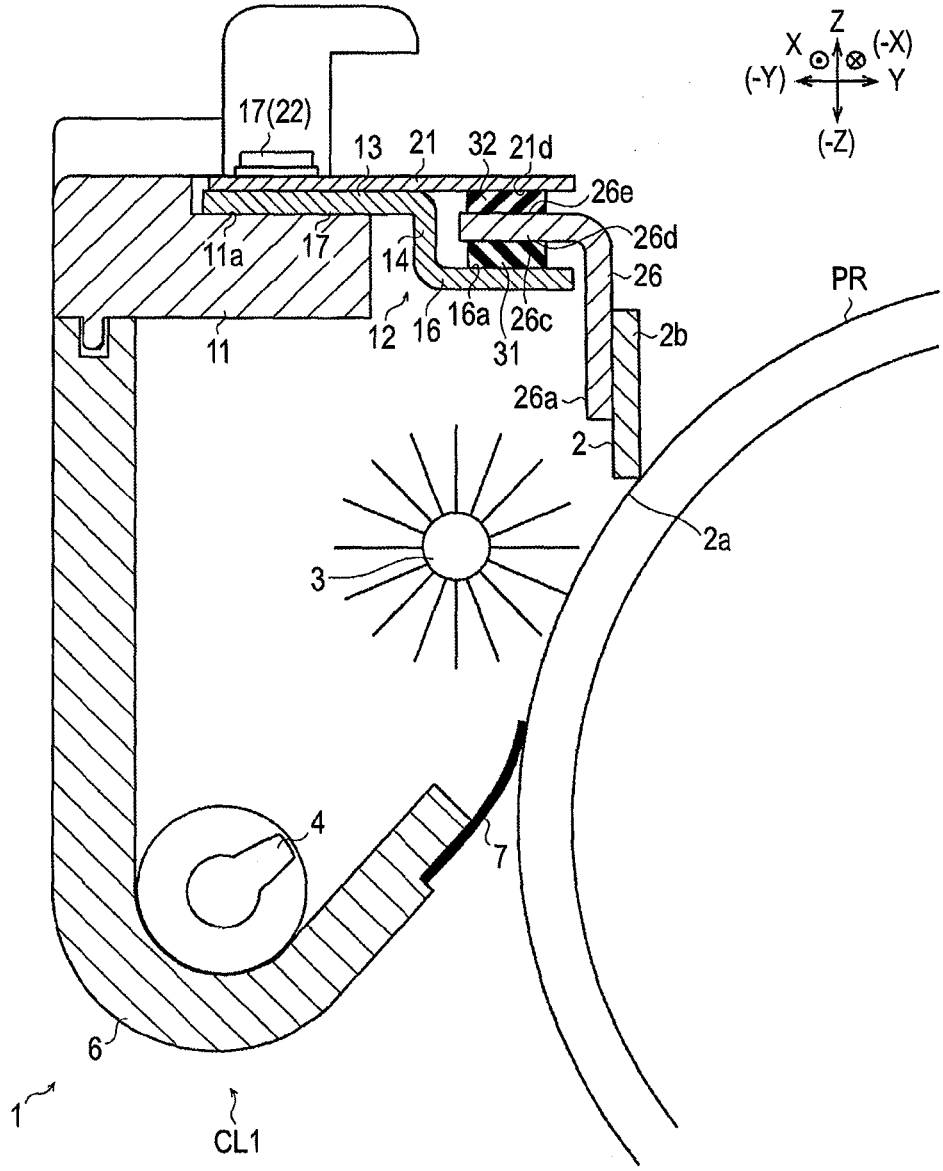
FIG. 2 is an enlarged view of principal parts of a cleaner portion of Example 1 of the invention.

FIG. 2 is an enlarged view of principal parts of a cleaner portion of Example 1 of the invention.

Figure 3:
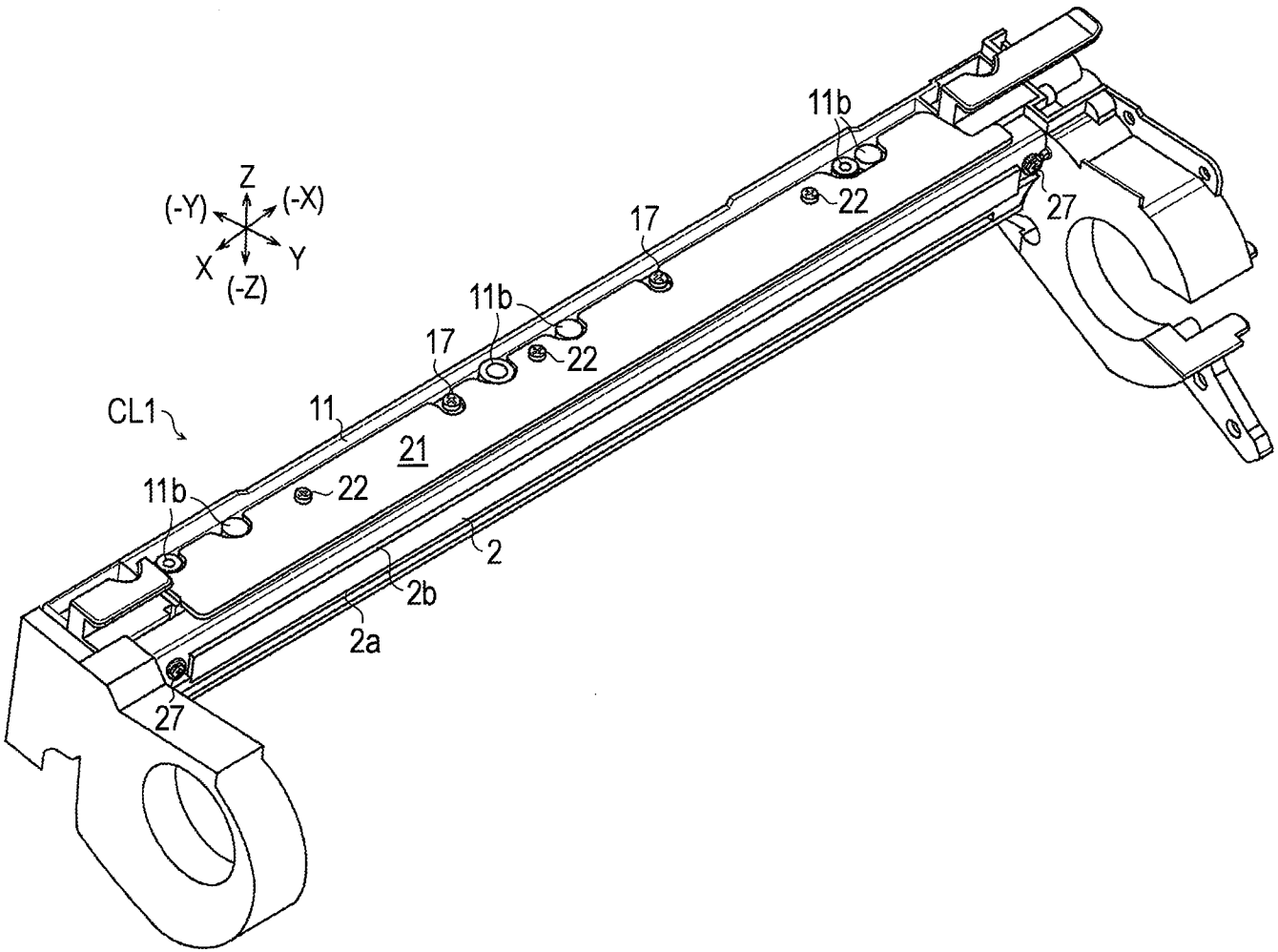
FIG. 3 is a perspective explanatory view of a state where an image carrier has been removed from an image carrier unit of Example 1.

FIG. 3 is a perspective explanatory view of a state where the image carrier has been removed from the image carrier unit of Example 1.

In FIGS. 1 to 3, the cleaner CL1 of Example 1 of the invention has a cleaning container 1 serving as an example of a main body of the cleaner. A cleaning blade 2 serving as an example of a cleaning member that has a distal end 2*a* brought into contact with the surface of the photoreceptor PR, thereby removing the residual toner remaining on the surface of the photoreceptor PR, and a cleaning brush 3 serving as an example of a second cleaning member that comes into contact with the surface of the photoreceptor PR closer to the upstream side in the rotational direction of the photoreceptor PR than the cleaning blade 2, thereby removing the residual toner, are arranged at the cleaning container 1. The residual toner removed by the cleaning blade 2 and the cleaning brush 3 is recovered to the cleaning container 1. The conveying member 4 that conveys the residual toner recovered by the cleaning container 1 toward a recovery container (not shown) is arranged inside the cleaning container 1.

In FIGS. 2 and 3, the cleaning container 1 has a main body 6 of the container that extends in the front-and-rear direction along the photoreceptor PR. In FIG. 2, a film seal 7 that extends toward the surface of the photoreceptor PR serves as an example of a leakage preventing member is fixed to and supported by the lower part of the main body 6 of the container on the side of the photoreceptor PR. The film seal 7 has an upper end brought into contact with the surface of the photoreceptor PR, and prevents residual toner from leaking out from the cleaning container 1 to the outside.

Figure 4:
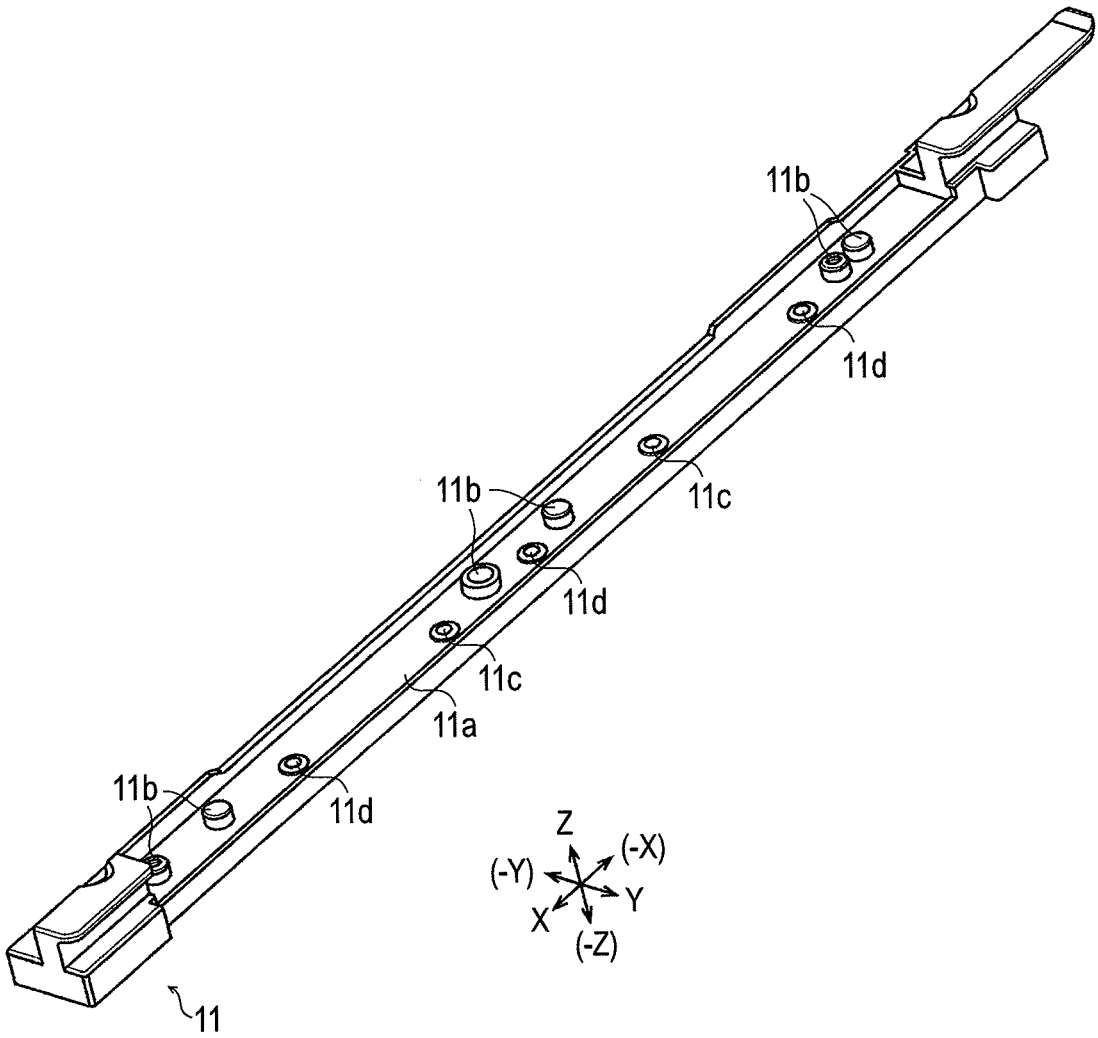
FIG. 4 is a perspective explanatory view of a support of a fixing member of Example 1.

FIG. 4 is a perspective explanatory view of a support of a fixing member of Example 1.

In FIG. 2, a container upper wall 11 serving as an example of the support of the fixing member is supported by an upper end of the main body 6 of the container. In FIGS. 2 to 3, the container upper wall 11 of Example 1 is formed in the shape of a plate that extends in the front-and-rear direction.

In FIG. 4, a plate fixing portion 11*a* serving as an example of a supporting portion of the fixing member is formed on the top face of a central part of the container upper wall 11 in the front-and-rear direction. The plate fixing portion 11*a* is formed with a pair of positioning projections 11*b*, serving as an example of positioning portions, that is formed at the central part in the front-and-rear direction, a front part, and a rear part, and protrudes upward. In addition, the spacing between three pairs of positioning projections 11*b* is set to different spacings between the front part, the central part, and the rear part.

A pair of front and rear screw holes 11*c* is formed on both front and rear sides of the positioning projections 11*b* at the central part, as an example of a fixing portion. Additionally, recesses 11*d* that are recessed downward are formed as an example of a receiving portion, in a total of three places outside the screw holes 11*c* in the front-and-rear direction and between the central positioning projections 11*b*.

Figure 5A:
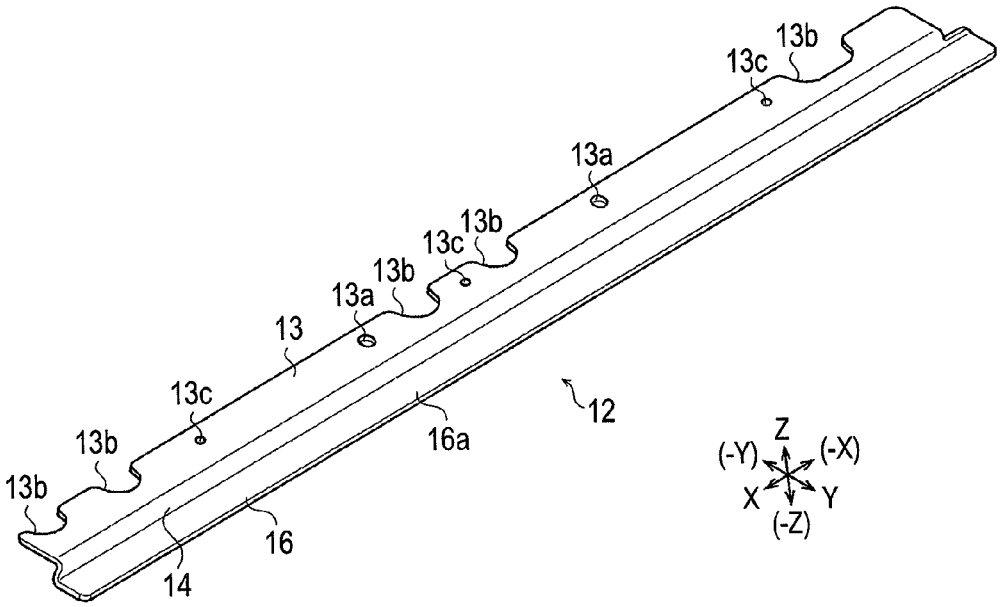
FIGS. 5A and 5B are explanatory views of a first fixing member of Example 1.
Figure 5B:
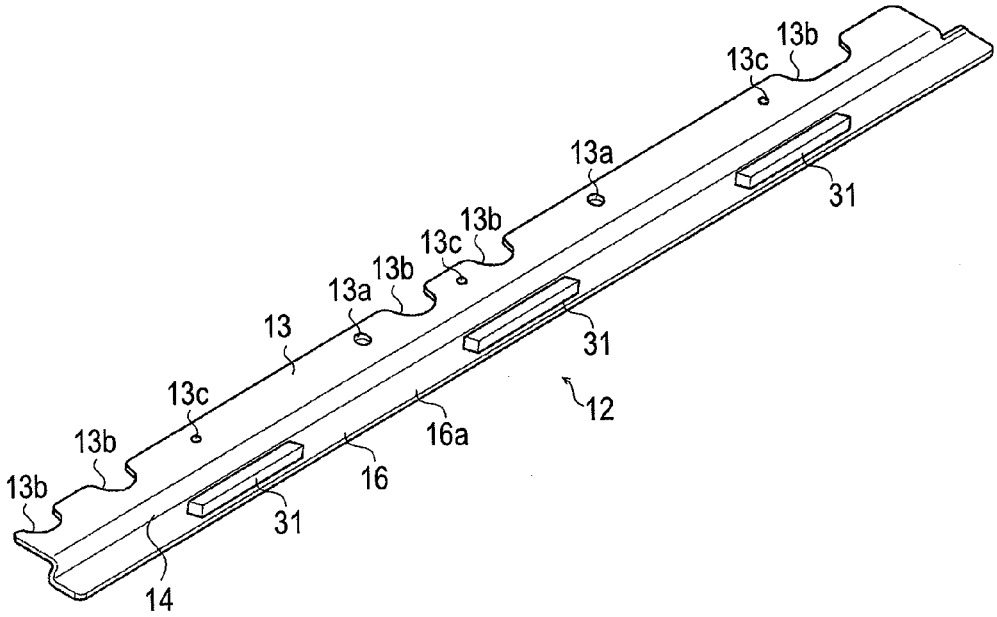

FIGS. 5A and 5B are explanatory views of a first fixing member of Example 1, FIG. 5A is a perspective view of the first fixing member, and FIG. 5B is an explanatory view of a state where a first damping member has been supported by the first fixing member.

In FIGS. 2, 3, and 5, a fixing sheet metal 12 serving as an example of the first fixing member is supported on the top face of the container upper wall 11. The fixing sheet metal 12 of Example 1 is formed by bending a metal sheet, which extends in the front-and-rear direction along the photoreceptor PR, in the shape of a crank, and has a fixed plate 13 that serves as an example of a fixed portion and supported by a plate fixing portion 11*a* of the container upper wall 11, a connecting portion 14 that serves as an example of a stepped portion and has a shape that is bent downward from a right end of the fixed plate 13, and a downward facing plate 16 that serves as an example of a first fixing portion and has a shape that is bent toward the right from the lower end of the connecting portion 14.

Round screw through-holes 13*a* are formed at positions corresponding to the screw holes 11*c* of the two fixing portions in the fixed plate 13. As shown in FIG. 3, the fixing sheet metal 12 is fixed to the container upper wall 11 with first fastening screws 17 that pass through the screw through holes 13*a*, and is screwed and fixed to the screw holes 11*c* of the fixing portions.

The fixed plate 13 is provided with cutout portions 13*b* serving as examples of positioned portions. The cutout portions are formed in a shape that is cut out in the shape of a semicircle at positions corresponding to the positioning projections 11*b* of the plate fixing portion 11*a*, and allow the positioning projections 11*b* to pass therethrough. Accordingly, in a case where the direction of attachment of the fixing sheet metal 12 to the plate fixing portion 11*a* or the way of attachment at the front and back or the like is wrong, the positioning projections 11*b* and the cutout portions 13*b* interfere with each other, not allowing installation. In a case where the way of attachment is right, the positioning projections 11*b* pass through the cutout portions 13*b*, allowing installation.

Additionally, three screw holes 13*c* serving as an example of fixing portions are formed at positions corresponding to the three recesses 11*d* in the fixed plate 13.

In FIG. 5, the top face of the downward facing plate 16 of the fixing sheet metal 12 is formed with a first rubber supporting face 16*a* serving as an example of a supporting portion of a first damping body.

In FIG. 5B, the damping member 31 is adhered on the fixing sheet metal 12 at a preset position with double-sided tape. Although crude rubber is used as the damping member, the damping member is not limited thereto, and can also be chloroprene rubber, silicone rubber, and other gels and cork. Additionally, the adhering method is also not limited to the double-sided tape, and the damping member may be adhered by conventionally well-known arbitrary methods, such as adhesives, or may be held by being pinched without adhering.

Figure 6:
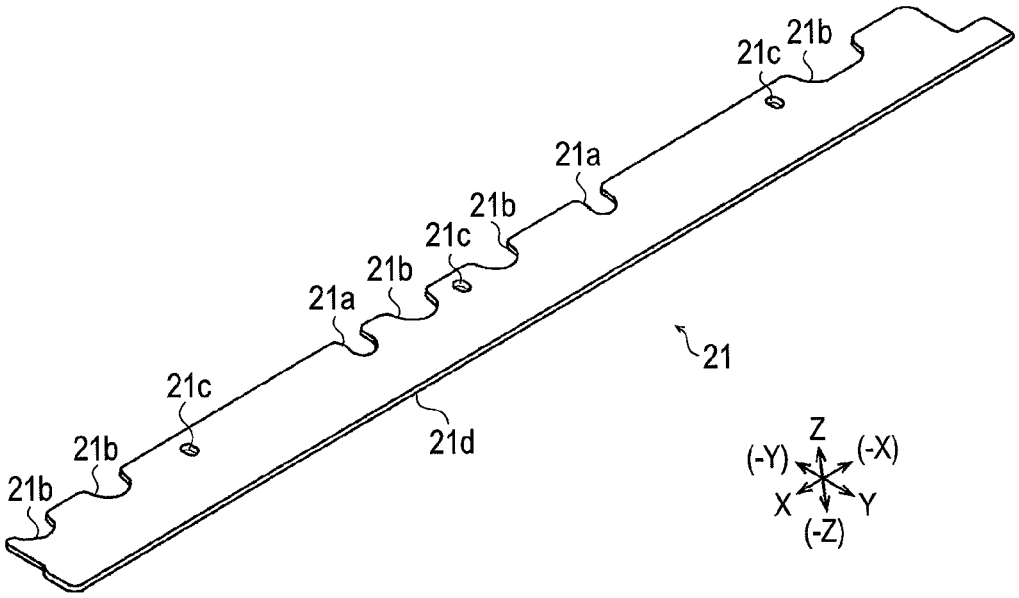
FIG. 6 is an explanatory view of a second fixing member of Example 1.

FIG. 6 is an explanatory view of a second fixing member of Example 1.

In FIGS. 2, 3, and 6, an upper fixing sheet metal 21 serving as an example of a second fixing member is supported on the top face of the fixing sheet metal 12. In FIG. 3 and FIG. 6, the upper fixing sheet metal 21 of Example 1 is formed with screw-avoiding grooves 21*a* serving as an example of screw avoiding portions. The screw-avoiding grooves are formed in a shape that is cut out so as not to interfere with the fastening screws 17, at positions corresponding to two fastenings screws 17. Additionally, the upper fixing sheet metal 21 is formed with second cutout portions 21*b* serving as an example of positioned portions, similarly to the cutout portions 13*b* of the fixing sheet metal 12. The second cutout portions are formed in a shape that is cut out in the shape of a semicircle at positions corresponding to the positioning projections 11*b*.

Additionally, three screw through holes 21*c* serving as an example of fixed portions are formed in the shape of a long hole at positions corresponding to the three screw holes 13*c* in the upper fixing sheet metal 21. Accordingly, as shown in FIG. 3, the upper fixing sheet metal 21 is fixed to the fixing sheet metal 12 with second fastening screws 22 that pass through the screw through holes 21*c* and are screwed and fixed to the screw holes 13*c*. In addition, in Example 1, the tips of the second fastening screws 22 that have passed through the screw holes 13*c* are fastened in the state of being received in the recesses 11*d*.

In FIG. 2, a second rubber supporting face 21*d* that faces the first rubber supporting face 16*a* is formed as an example of a supporting portion of a second damping body, on the right bottom face of the upper fixing sheet metal 21.

A rubber fixing member 12+21 serving as an example of a fixing member of a damping body is constituted by the fixing sheet metal 12 and the upper fixing sheet metal 21.

Figure 7A:
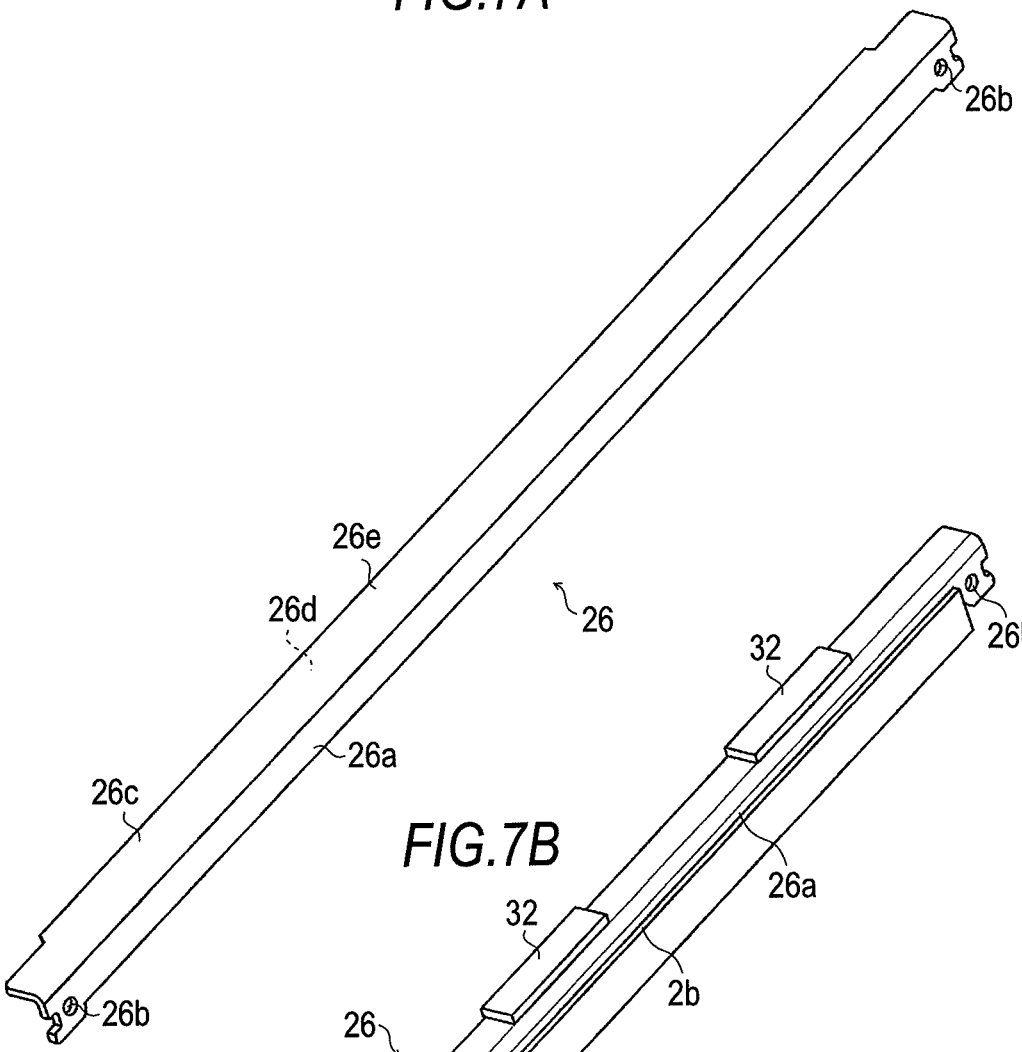
FIGS. 7A and 7B are explanatory views of a cleaning support of Example 1.
Figure 7B:
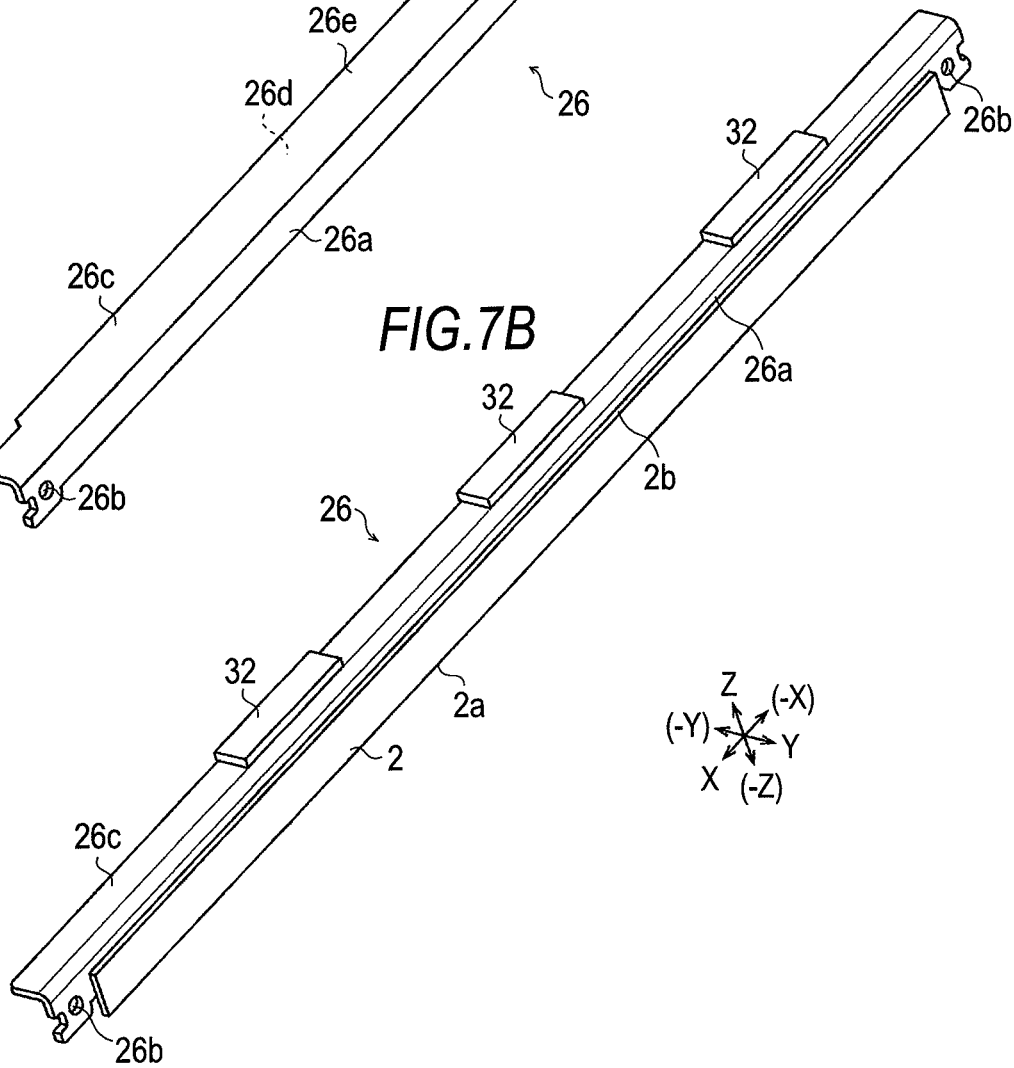

FIGS. 7A and 7B are explanatory views of a cleaning support of Example 1, FIG. 7A is a perspective view of the cleaning support, and FIG. 7B is an explanatory view of a state where a cleaning member and a second damping member are supported by the cleaning support.

In FIGS. 2 and 3, a blade sheet metal 26 that supports a proximal end 2*b* of the cleaning blade 2 is arranged as an example of the cleaning support on the right of the rubber fixing member 12+21.

In FIGS. 2, 3, and 7, the blade sheet metal 26 of Example 1 is formed in the shape of a plate that has a cross-section that is bent in an L-shape, and extends in the front-and-rear direction. The blade sheet metal 26 has a blade supporting portion 26*a* serving as an example of a cleaning supporting portion that is formed in the shape of a plate that extends along the up-and-down direction from the distal end 2*a* of the cleaning blade 2 toward the proximal end 2*b* thereof, and supports the proximal end 2*b* of the cleaning blade 2.

Screw through holes 26*b* serving as an example of supported portions are formed at both front and rear ends of the blade supporting portion 26*a* of Example 1. Accordingly, as shown in FIG. 3, the blade sheet metal 26 is supported by the main body 6 of the container with screws 27 serving as an example of fastening members that pass through the screw through holes 26*b*. Hence, the cleaning blade 2 is fixed by the fixation of blade sheet metal 26 with the screws 27, and the contact pressure of the cleaning blade with the photoreceptor PR is set to a preset pressure. That is, the distal end of the cleaning blade 2 in the state of not being elastically deformed in terms of design is set to have a set angle that is a preset angle and a biting amount that is a set biting amount value, with respect to the surface of the photoreceptor PR by the fixation of the blade sheet metal 26 to the main body 6 of the container. In addition, in Example 1, 25 degrees is set as an example of the set angle, and 1.4 mm is set as an example of the biting amount.

Additionally, the blade sheet metal 26 has a curved portion 26*c* serving as an example of a damped portion that extends to the left, that is, a direction curved with respect to the up-and-down direction in which the blade supporting portion 8*a* extends. The curved portion 26*c* of Example 1 is arranged so as be sandwiched between the downward facing plate 16 of the fixing sheet metal 12, and the upper fixing sheet metal 21.

A first damped face 26*d* serving as an example of a first damped portion is constituted by a bottom face serving as an example of one face, at a left portion of the curved portion 26*c*, and the first damped face 26*d* is arranged so as to face the first rubber supporting face 16*a*. Additionally, a second damped face 26*e* serving as an example of a second damped portion is constituted by a top face serving as an example of the other face, at a left portion of the curved portion 26*c*, and the second damped face 26*e* is arranged so as to face the second rubber supporting face 21*d*.

In FIGS. 2 and 5, a lower damping rubber 31 serving as an example of the first damping body is arranged in the state of being sandwiched between the first rubber supporting face 16*a* and the first damped face 26*d*. The lower damping rubber 31 of Example 1 is constituted of rubber serving as an example of an elastic material. As shown in FIG. 5, three lower damping rubbers are supported at preset intervals with respect to the front-and-rear direction. In FIG. 2, the lower damping rubber 31 of Example 1 is supported in a state where the bottom face thereof is supported by the first rubber supporting face 16*a* of the fixing sheet metal 12 and the top face thereof is supported in the state of coming into contact with the first damped face 26*d*, and is elastically deformed so as to be shorter than its natural length and sandwiched in a shrunken state.

In FIGS. 2 and 7B, similarly to the lower damping rubber 31, an upper damping rubber 32 serving as an example of the second damping body is arranged in the state of being sandwiched between the second rubber supporting face 21*d* and the first damped face 26*e*. The upper damping rubber 32 of Example 1 is constituted of rubber serving as an example of an elastic material similarly to the lower damping rubber 31, and is adhered at a corresponding position on the rear side of the lower damping rubber 31 with double-sided tape across the curved portion 26*c*. Additionally, the upper damping rubber 32, similarly to the lower damping rubber 31, is also elastically deformed and sandwiched in a shrunken state between the second rubber supporting face 21*d* and the second damped face 26*e*.

A damping rubber 31+32 serving as an example of the damping body of Example 1 is constituted by the lower damping rubber 31 and the upper damping rubber 32 so as to sandwich the curved portion 26C of the blade sheet metal 26.

(Operation of Example 1)

In the image forming apparatus U of Example 1 including the above configuration, after an image formed on the surface of the photoreceptor PR is transferred to the sheet S, the residue that has remained on the surface of the photoreceptor PR is removed by the cleaning brush 3 and the cleaning blade 2. In the plate-shaped cleaning blade 2 that comes in contact with the photoreceptor PR, contact pressure fluctuates due to the amount or distribution of a residue that remains on the surface of the photoreceptor PR, the irregularities of the surface of the photoreceptor PR, the eccentricity of the photoreceptor PR, or the like. Accordingly, the distal end 2*a* of the cleaning blade 2 may receive a force by which the distal end is deformed in a direction in which the distal end is rolled along the surface of the photoreceptor PR, or a direction in which the distal end elongates and contracts, and vibration may be generated in the cleaning blade 2. When vibration is generated in the cleaning blade 2, the blade sheet metal 26 on which the cleaning blade 2 is supported may also vibrate, and a noise may be generated.

On the other hand, in the cleaner CL1 of Example 1, the damping rubber 31+32 arranged between the blade sheet metal 26 and the rubber fixing member 12+21 absorbs and attenuates vibration, thereby reducing a noise.

Figure 8A:
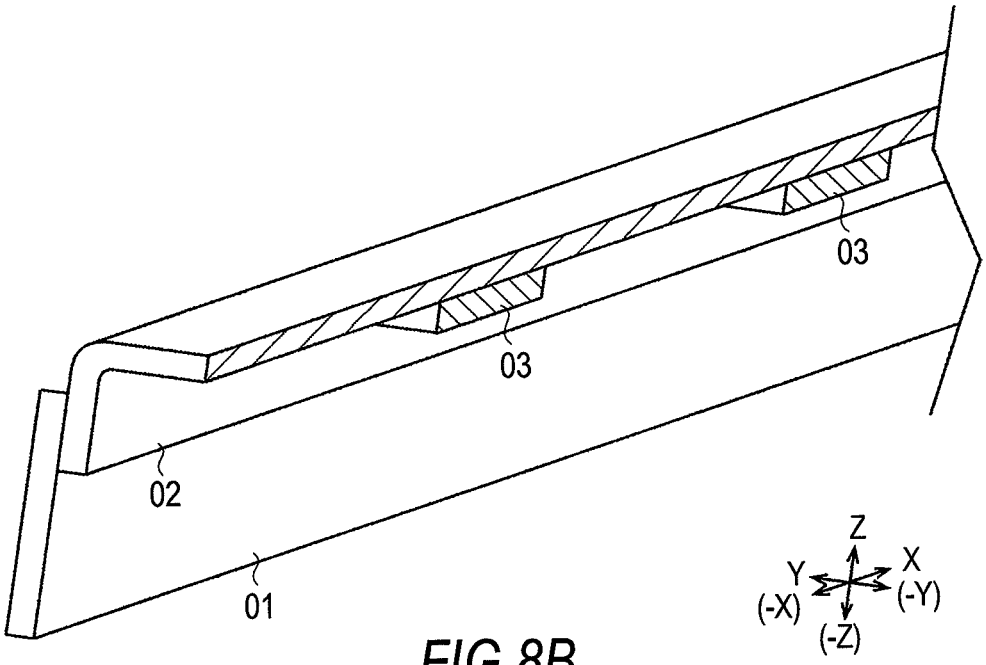
FIGS. 8A and 8B are explanatory views of a conventional configuration.
Figure 8B:
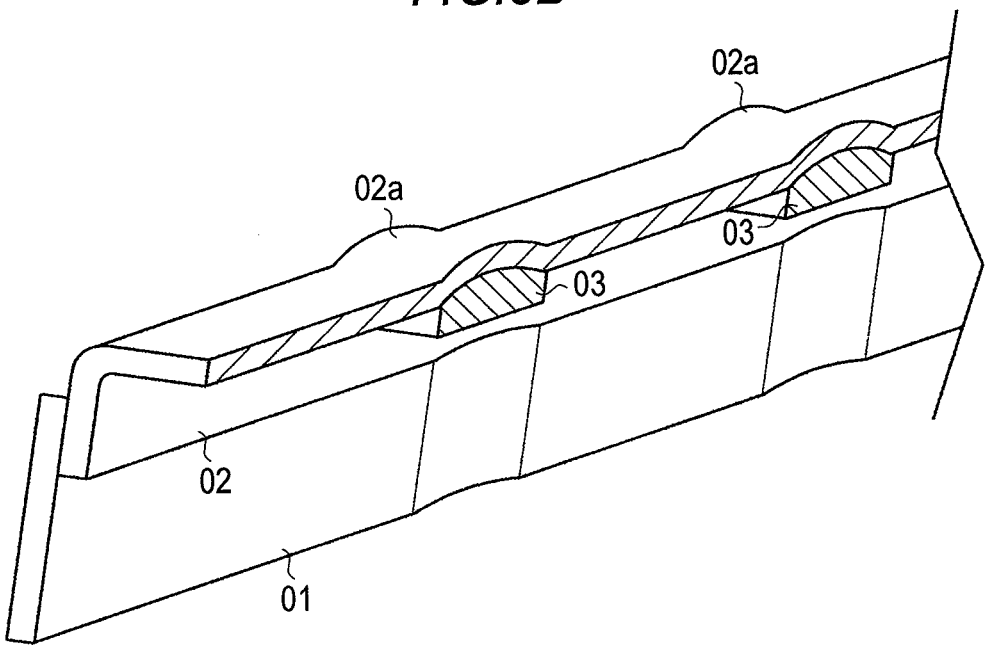

FIGS. 8A and 8B are explanatory views of a conventional configuration, FIG. 8A is an explanatory view of a state where the damping member has been brought into contact with the cleaning support in a shrunken state, and FIG. 8B is an explanatory view of a state where the cleaning support has been deflected by the elastic force of the damping member.

In FIGS. 8A and 8B, in a conventional configuration in which a damping rubber 03 is arranged only on one face of a blade sheet metal 02 that supports a cleaning blade 01 as in the conventional technique, as shown in FIG. 8B, in the blade sheet metal 02, deflection may occur in a portion 02*a* on which the elastic force of the damping rubber 03 acts, and distortion, such as corrugation or waviness, may occur in the longitudinal direction. When distortion of the blade sheet metal 02 occurs, the cleaning blade 01 to be supported may be adversely affected, the pressure of the cleaning blade that comes into contact with image carrier may vary in the longitudinal direction, and cleaning capability may decline.

On the other hand, in the photoreceptor cleaner CL1 of Example 1, the blade sheet metal 26 is sandwiched with the same pressure by the damping rubbers 31 and 32 from both sides. Thus, distortion occurs in neither the blade sheet metal 26 nor a cleaning blade 2, and degradation of the cleaning performance of a cleaning blade 2 is reduced.

Additionally, in the photoreceptor cleaner CL1 of Example 1, the blade sheet metal 26 is supported by the fixing sheet metals 12 and 21 via the damping rubbers 31 and 32, is not brought into contact with the fixing sheet metals 12 and 21 directly, and is not fixed with screws or the like. Accordingly, the blade sheet metal 26 is little influenced by the precision or the like of the parts of the fixing sheet metals 12 and 21, and is supported by the main body 6 of the container with the screws 27, and it is easy to attain precision in the position of the blade sheet metal 26 and the cleaning blade 2. That is, in a case where the precision of the flatness, squareness, or the like of the fixing sheet metals 12 and 21 is poor, the blade sheet metals fixed thereto are also influenced, and the attachment precision thereof will deteriorate along with the fixing sheet metals 12 and 21. However, such an adverse effect can also be prevented in the photoreceptor cleaner CL1 of Example 1.

Moreover, the blade sheet metal 26 of Example 1 is formed in an L-shape, the rigidity of the blade sheet metal is higher compared to a flat plate-shaped configuration, and distortion of the blade sheet metal caused by the elastic force of damping rubber 31 and 32 does not easily occur. Even if the distortion occurs, the distortion is easily absorbed by the curved portion 26*c*, and the possibility that an adverse effect may be exerted on the blade supporting portion 26*a* and the cleaning blade 2 is low.

Moreover, the fixing sheet metal 12 of Example 1 is bent in the shape of a crank, and is formed, and the fixed plate 13 and the downward facing plate 16 are connected together stepwise by the connecting portion 14. Hence, the crank-like fixing sheet metal 12 has rigidity that is structurally higher compared to a flat plate-like form, and is pushed to the lower damping rubber 31, and thereby the downward facing plate 16 is curved. As a result, occurrence of undulations that become wavelike irregularities in the downward facing plate 16 is reduced.

Additionally, even if undulations are generated in the downward facing plate 16, undulations are easily absorbed by the connecting portion 14 compared to the flat plate-like form, and undulations are not easily generated in the fixed plate 13. Accordingly, adverse effects, such as distortion from the elastic force of the lower damping rubber 31, on the fixing sheet metal 12 or the container upper wall 11 are reduced.

Additionally, in Example 1, the rubber fixing member 12+21 has a structure in which the two members of the fixing sheet metal 12 and the upper fixing sheet metal 21 are connected together with the screws 22 rather than an integrally formed member. If the rubber fixing member 12+21 is integrally formed, and is assembled to the cleaning container 1, it is necessary to assemble the rubber fixing member in a state where the damping rubber 31+32 and the curved portion 26*c* are sandwiched, and assembly work becomes troublesome. On the other hand, in the configuration of Example 1, the assembly work becomes the work of fixing the fixing sheet metal 12, the first damping rubber 31, the curved portion 26*c*, the second damping rubber 32, and the upper fixing sheet metal 21 in order, and it is possible to perform the assembly work comparatively easily.

EXAMPLE 2

Figure 9:
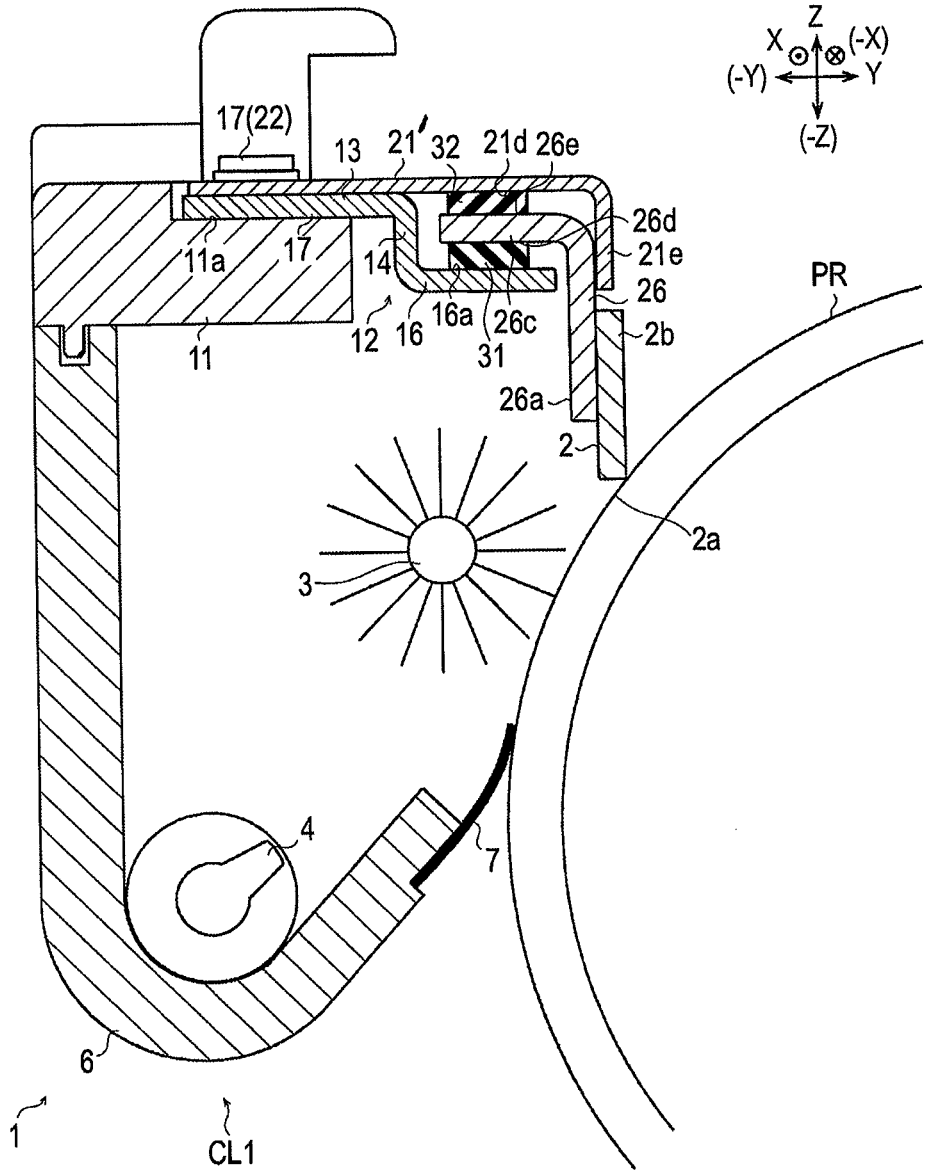
FIG. 9 is an explanatory view of a cleaner of Example 2, and is a view corresponding to FIG. 2 of Example 1.

FIG. 9 is an explanatory view of a cleaner of Example 2, and is a view corresponding to FIG. 2 of Example 1.

Figure 10:
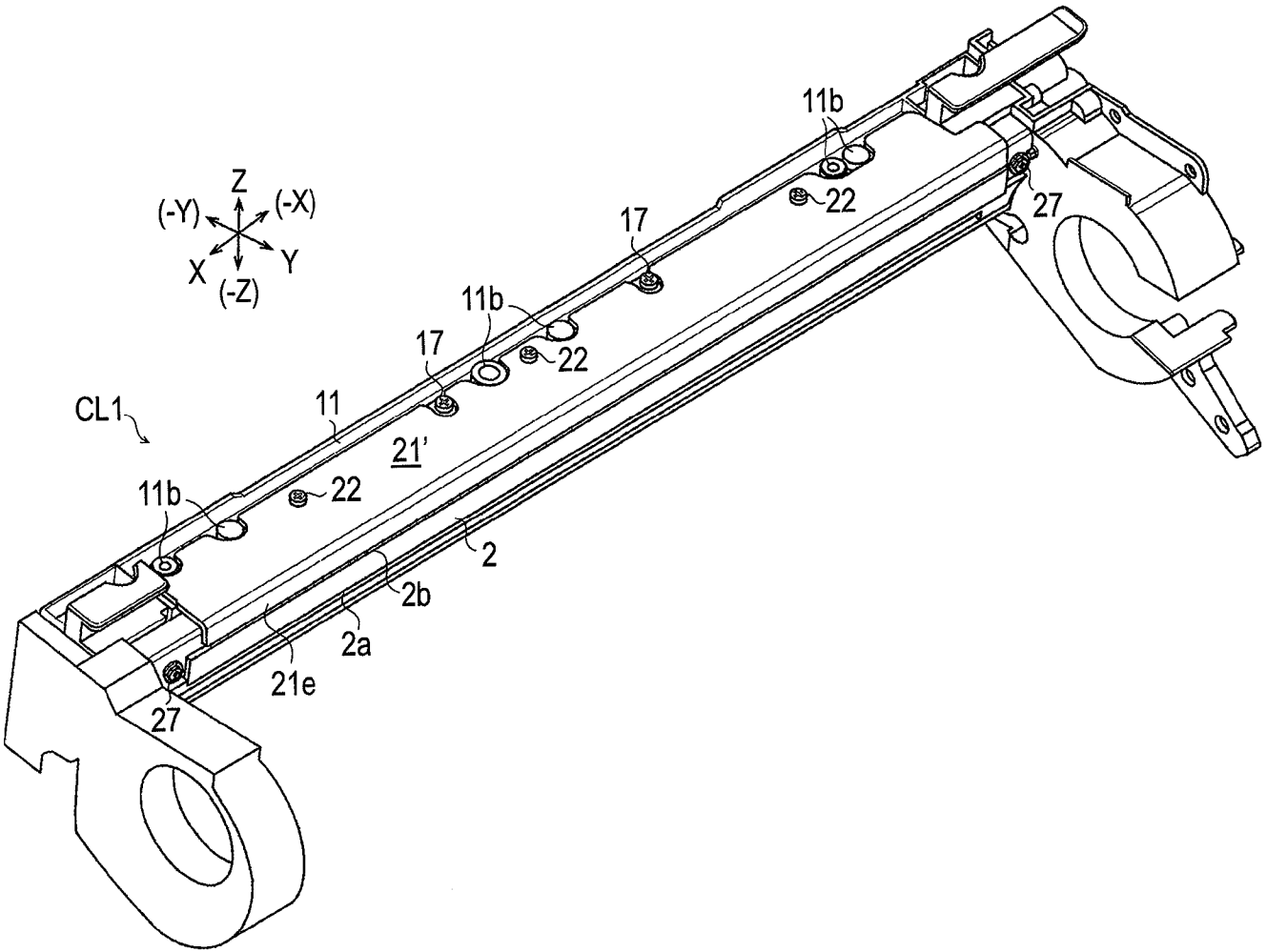
FIG. 10 is a perspective explanatory view of a state where an image carrier has been removed from an image carrier unit of Example 2, and is a view corresponding to FIG. 3 of Example 1.

FIG. 10 is a perspective explanatory view of a state where an image carrier has been removed from an image carrier unit of Example 2, and is a view corresponding to FIG. 3 of Example 1.

Figure 11:
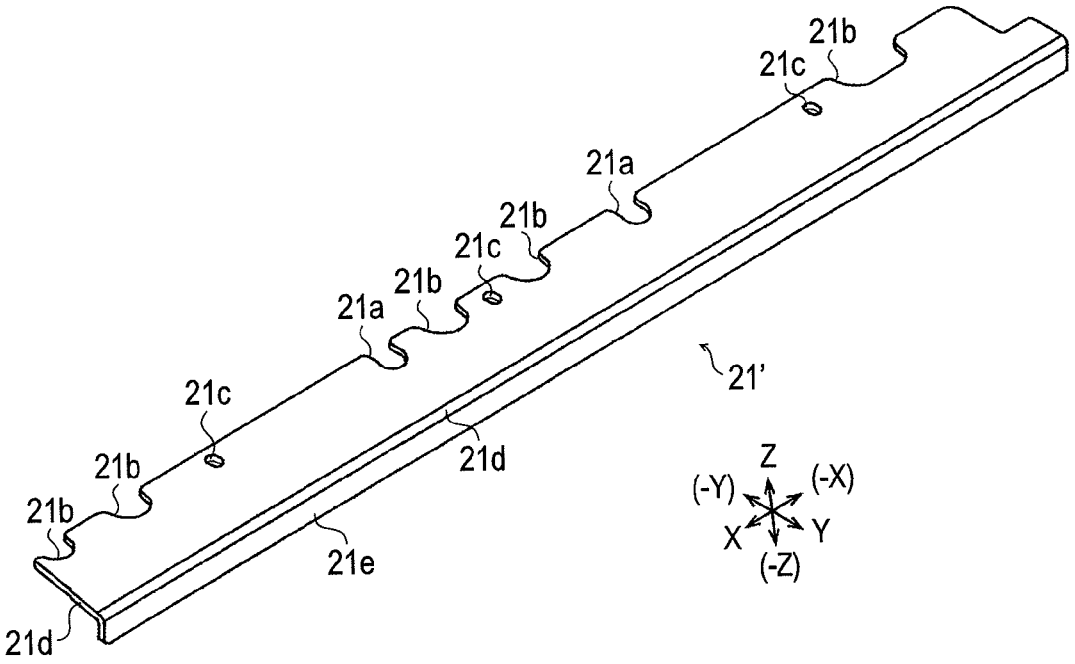
FIG. 11 is an explanatory view of a second fixing member of Example 2, and is a view corresponding to FIG. 6 of Example 1.

FIG. 11 is an explanatory view of a second fixing member of Example 2, and is a view corresponding to FIG. 6 of Example 1.

Next, although Example 2 of the invention will be described, in the description of this Example 2, the same reference numerals will be given to constituent elements corresponding to the constituent elements of Example 1, and detailed description thereof will be omitted.

Although this Example 2 is different from Example 1 in respect of the following points, Example 2 is configured similarly to Example 1 in other points.

In FIGS. 9 to 11, compared to the fixing sheet metal 21 of Example 1, an upper fixing sheet metal 21' of Example 2 serving as an example of the second fixing member is formed with a bent portion 21*e* that is bent downward from a right end, and is configured similarly to the fixing sheet metal 21 of Example 1 except that the rigidity thereof is improved as a whole compared to the fixing sheet metal 21 of Example 1. In addition, as shown in FIGS. 9 and 10, the bent portion 21*e* of Example 2 is arranged in proximity with the right of the blade supporting portion 26*a* of the blade sheet metal 26.

A rubber fixing member 12+21' of Example 2 is constituted by the fixing sheet metal 12 and the upper fixing sheet metal 21'.

(Operation of Example 2)

In the photoreceptor cleaner CL1 of Example 2 including the above configuration, the rigidity of the fixing sheet metal 21' is improved, and the fixing sheet metal 21' is not easily distorted by the elastic force of the upper damping rubber 32. Accordingly, when the fixing sheet metal is distorted by the elastic force of the upper damping rubber 32, the amount of shrinkage of the upper damping rubber 32 fluctuates and thus the elastic force fluctuates, the balance with the elastic force of the lower damping rubber 31 is collapsed, and the curved portion 26*c* of the blade sheet metal 26 may be distorted, or the position of the curved portion may fluctuate. However, in Example 2, the rigidity of the fixing sheet metal 21' is improved, and occurrence of these problems is reduced.

EXAMPLE 3

Figure 12:
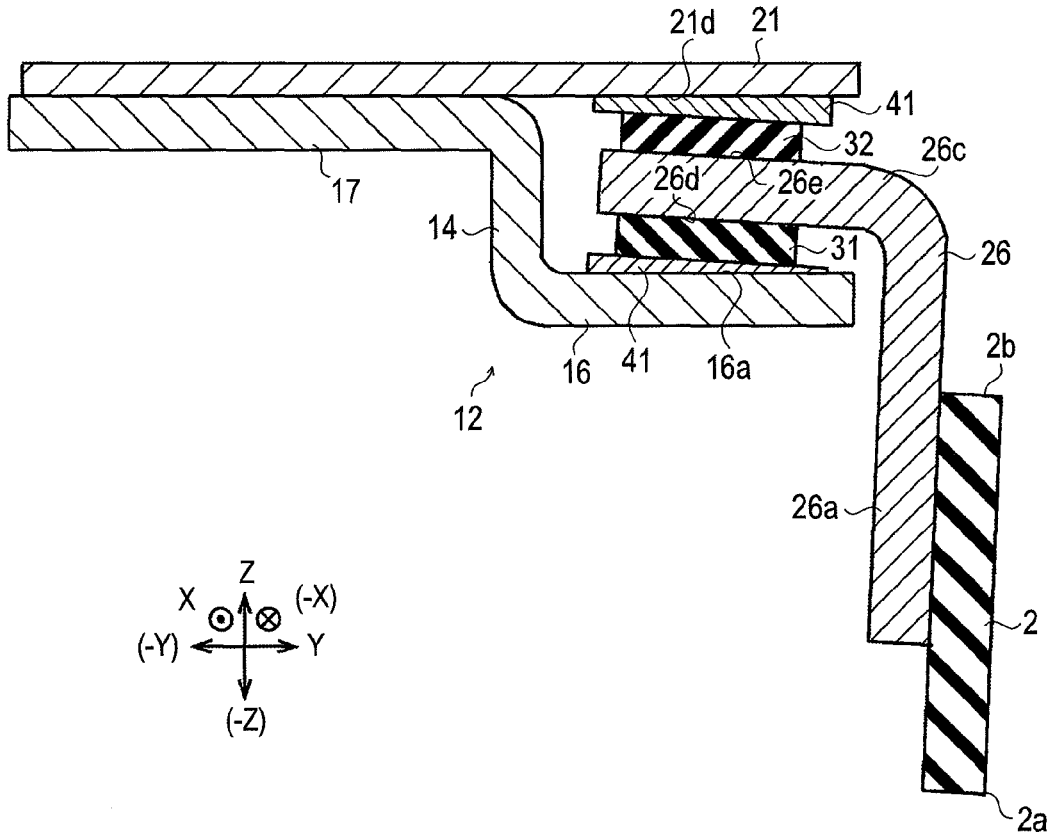
FIG. 12 is an explanatory view of principal parts of the cleaning member, the cleaning support, the damping body, and the fixing member of the damping body in Example 3.

FIG. 12 is an explanatory view of principal parts of the cleaning member, the cleaning support, the damping body, and the fixing member of the damping body in Example 3.

Next, although Example 3 of the invention will be described, in the description of this Example 3, the same reference numerals will be given to constituent elements corresponding to the constituent elements of Example 1, and detailed description thereof will be omitted.

Although this Example 3 is different from Example 1 in respect of the following points, Example 3 is configured similarly to Example 1 in other points.

In FIG. 12, compared to the cleaning blade 2 of Example 1, the cleaning blade 2 of Example 3 has a different setting regarding the angle at which the cleaning blade comes into contact with the photoreceptor PR, and is arranged in a state where the curved portion 26*c* is inclined with respect to a direction in which the fixing sheet metals 12 and 21 face each other. Accordingly, in the photoreceptor cleaner CL1 of Example 3, a wedge-shaped shim 41 according to the inclination of the curved portion 26*c* is sandwiched between each of the fixing sheet metals 12 and 21 and each of the damping rubbers 31 and 32, as an example of an angle-adjusting member.

(Operation of Example 3)

Figure 13A:
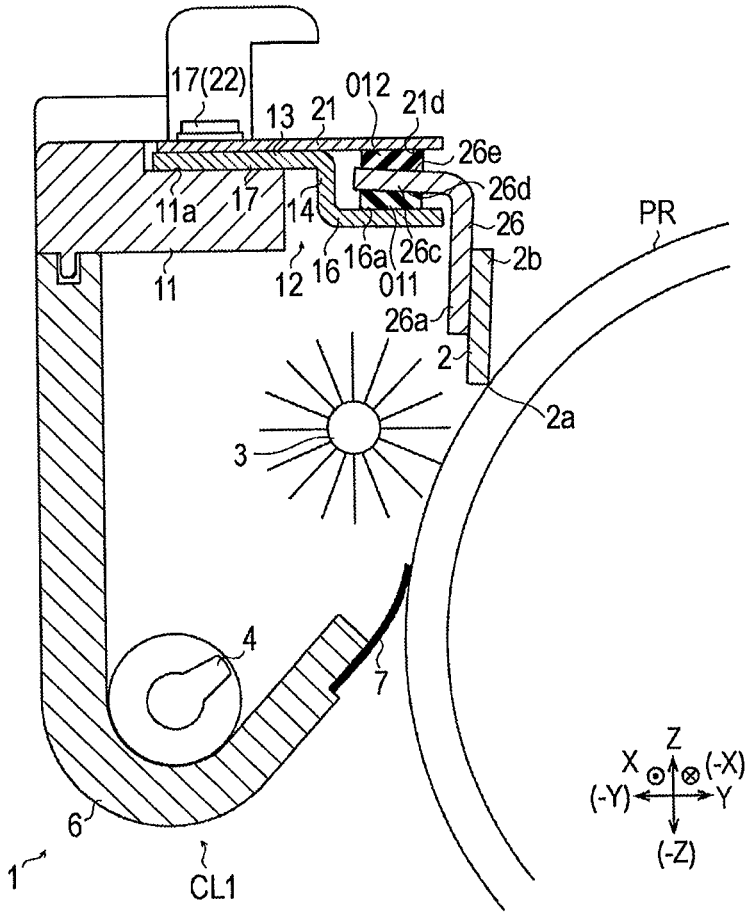
FIGS. 13A and 13B are explanatory views of a case where an angle adjusting member of Example 3 is not used.
Figure 13B:
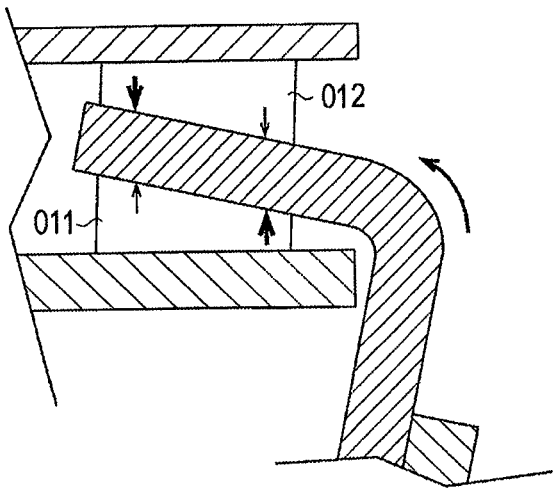

FIGS. 13A and 13B are explanatory views of a case where the angle adjusting member of Example 3 is not used, FIG. 13A is an overall view of the cleaner of Example 3, and FIG. 13B is an enlarged view of the damping rubber portion.

In the photoreceptor cleaner CL1 of Example 3 including the above configuration, the wedge-shaped shim 41 according to the inclination of the curved portion 26*c* is inserted between the fixing sheet metal 12 or 21 and the damping rubber 31 or 32. In FIGS. 13A and 13B, in a case where the shim 41 is not used in the setting where the curved portion 26*c* is inclined as shown in FIG. 13A, damping rubbers 011 and 012 are elastically deformed into a trapezoidal shape as shown in FIG. 13B. In this case, the elastic restoring force that acts on the curved portion 26*c* becomes large in the portions where the amounts of shrinkage, i.e., amounts of elastic deformation, of the damping rubbers 011 and 012 are large, and the elastic restoring force becomes small in the portions where the amounts of elastic deformation are small. Accordingly, in a case where the curved portion 26*c* is inclined, as shown in FIG. 13B, the elastic restoring force is different in the upper and lower damping rubbers 011 and 012, and a rotational moment acts on the blade sheet metal 26. Thus, there is a concern that the blade sheet metal 26 may be distorted. When the blade sheet metal 26 is distorted, the attachment angle of the cleaning blade 2 will be affected. On the other hand, in Example 3, as shown in FIG. 12, the wedge-shaped shim 41 according to the inclination of the curved portion 26*c* is sandwiched. Thus, the sections of the damping rubbers 31 and 32 do not easily become a trapezoidal shape, and the sections of the damping rubbers easily become a quadrangular shape. Accordingly, a situation where the force acting on blade sheet metal 26 is different in the upper and lower damping rubbers is reduced, and distortion of the blade sheet metal 26 is reduced.

EXAMPLE 4

Figure 14A:
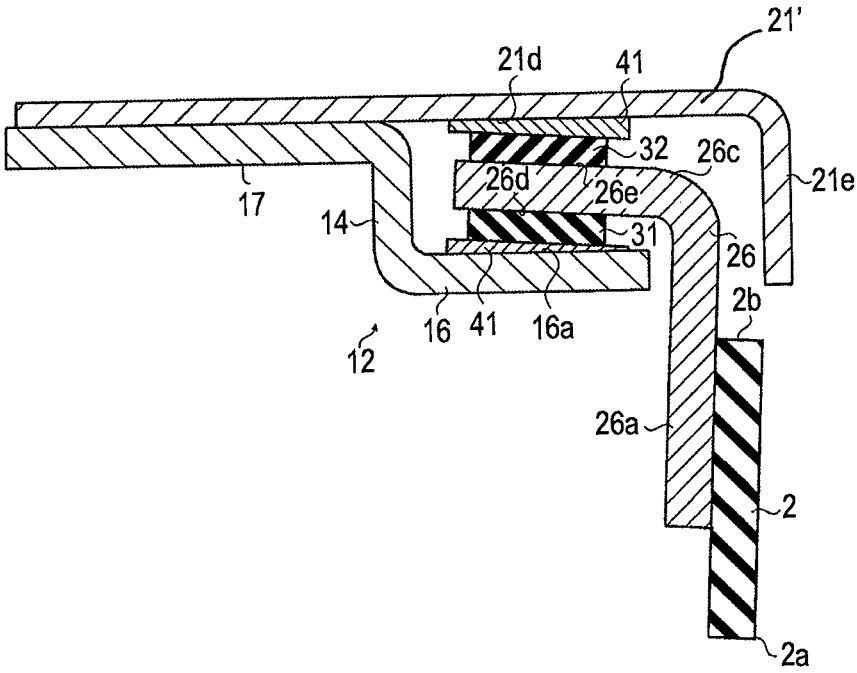
FIGS. 14A and 14B are explanatory views of principal parts of the cleaning member, the cleaning support, the damping body, and the fixing member of the damping body in examples of the invention.
Figure 14B:
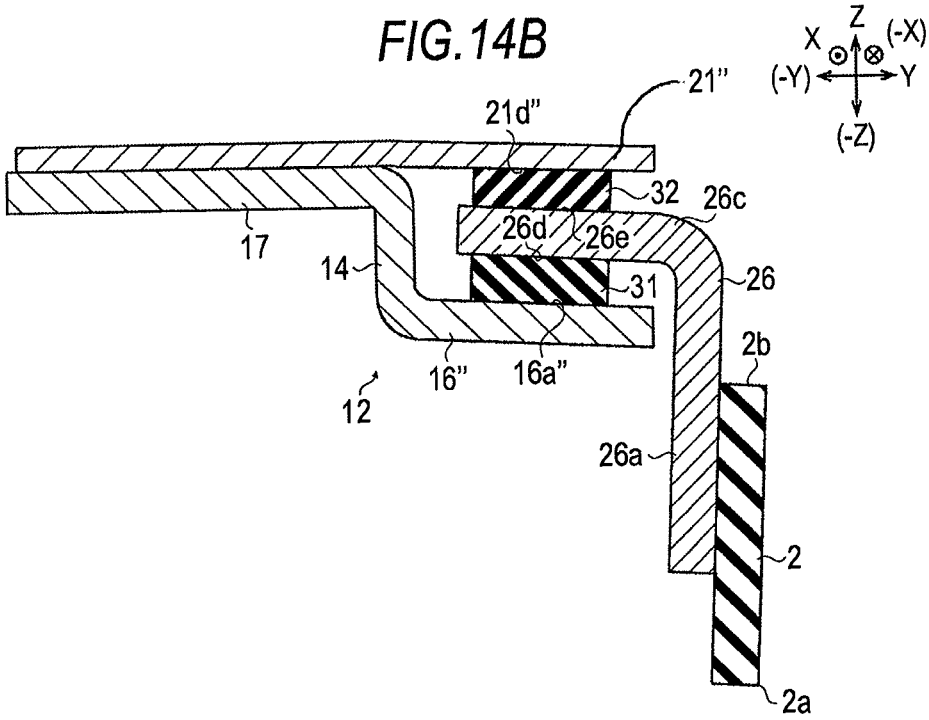

FIGS. 14A and 14B are explanatory views of principal parts of the cleaning member, the cleaning support, the damping body, and the fixing member of the damping body in examples of the invention, FIG. 14A is an explanatory view of principal parts of Example 4, and FIG. 14B is an explanatory view of principal parts of Example 5.

Next, although Example 4 of the invention will be described, in the description of this Example 4, the same reference numerals will be given to constituent elements corresponding to the constituent elements of Examples 1 to 3, and detailed description thereof will be omitted.

Although this Example 4 is different from Example 1 to 3 in respect of the following points, Example 4 is configured similarly to Examples 1 to 3 in other points.

In FIG. 14A, the photoreceptor cleaner CL1 of Example 4 is combined by the configuration of the fixing sheet metal 21' of Example 2 and the shim 41 of Example 3.

(Operation of Example 4)

In the photoreceptor cleaner CL1 of Example 4 including the above configuration, the rigidity of fixing sheet metal 21' is improved similarly to Example 2, and the shim 41 is used to reduce collapse of the balance between forces on the upper and lower sides of the blade sheet metal 26, and distortion of the blade sheet metal 26 is reduced.

EXAMPLE 5

Next, although Example 5 of the invention will be described, in the description of this Example 5, the same reference numerals will be given to constituent elements corresponding to the constituent elements of Example 1, and detailed description thereof will be omitted.

Although this Example 5 is different from Example 1 in respect of the following points, Example 5 is configured similarly to Example 1 in other points.

In FIG. 14B, in the photoreceptor cleaner CL1 of Example 5, instead of using the shim 41 of Example 3, a second rubber supporting face 21*d* "of a fixing sheet metal 21" and a first rubber supporting face 16*a* "of a lower facing plate 16" are obliquely inclined according to the inclination of the curved portion 26*c*, compared to the rubber supporting faces 16*a* and 21*d* of Example 1.

(Operation of Example 5)

In the photoreceptor cleaner CL1 of Example 5 including the above configuration, similarly to Examples 3 and 4, the damping rubbers 31 and 32 supported by the inclined rubber supporting faces 16*a*" and 21*d*" are not easily deformed into a trapezoidal shape, and distortion of the blade sheet metal 26 is reduced.

EXAMPLE 6

Figures 15A, 15B, 15C, 15D:
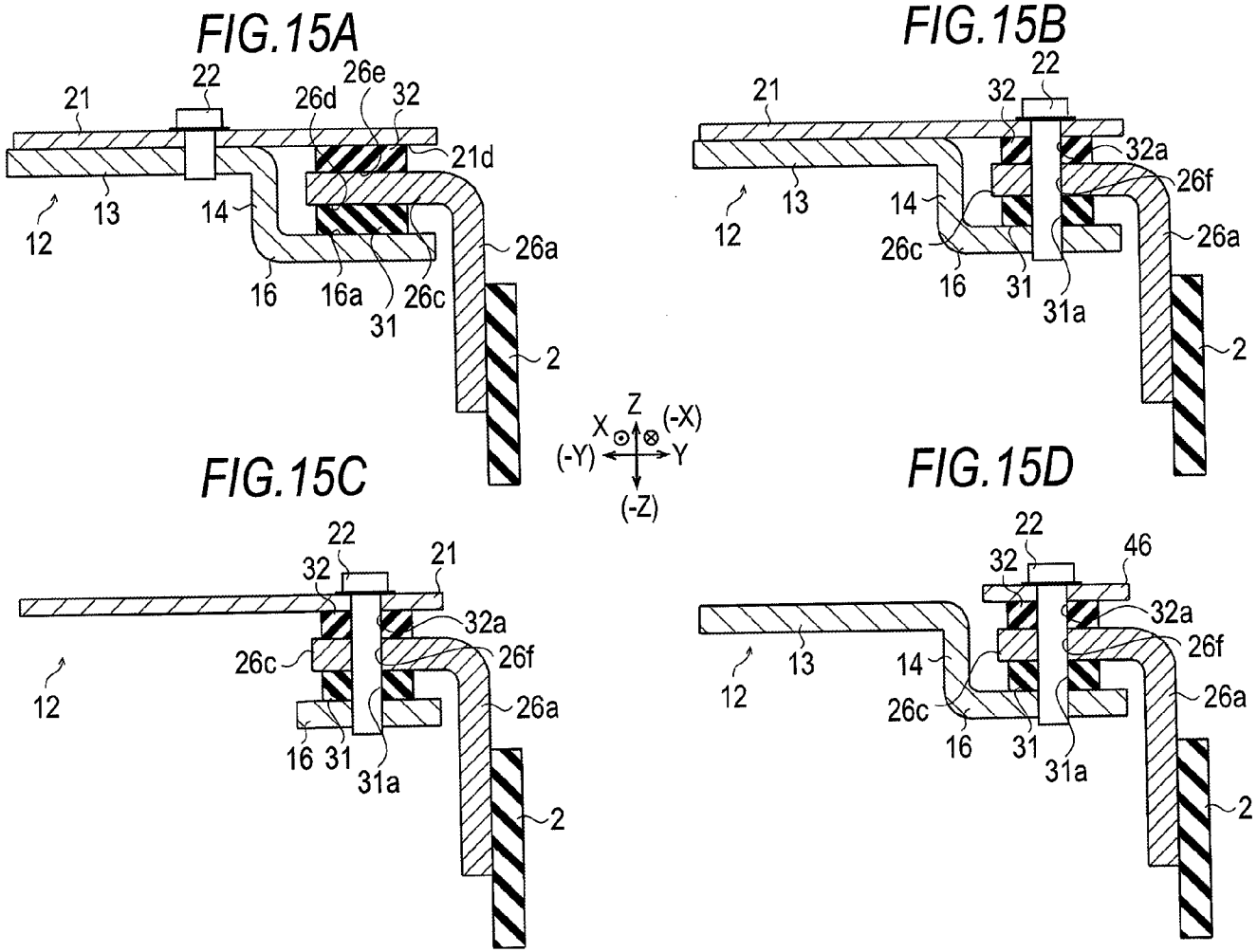
FIGS. 15A to 15D are explanatory views of principal parts of the cleaning member, the cleaning support, the damping body, and the fixing member of the damping body in examples of the invention.

FIGS. 15A to 15D are explanatory views of principal parts of the cleaning member, the cleaning support, the damping body, and the fixing member of the damping body in examples of the invention, FIG. 15A is an explanatory view of principal parts of Example 6, FIG. 15B is an explanatory view of principal parts of Example 7, FIG. 15C is an explanatory view of principal parts of Example 8, and FIG. 15D is an explanatory view of principal parts of Example 9.

Next, although Example 6 of the invention will be described, in the description of this Example 6, the same reference numerals will be given to constituent elements corresponding to the constituent elements of Example 1, and detailed description thereof will be omitted. Although this Example 6 is different from Example 1 in respect of the following points, Example 6 is configured similarly to Example 1 in other points.

In FIG. 15A, as for the photoreceptor cleaner CL1 of Example 6, the position where the fixing sheet metal 12 and the upper fixing sheet metal 21 are fastened with the fastening screws 22 is set to the vicinity of the boundary between the fixed plate of the fixing sheet metal 12, and the connecting portion 14, unlike the configuration of Example 1 in which the fixing sheet metals 12 and 21 are fastened at left ends thereof.

(Operation of Example 6)

In the photoreceptor cleaner CL1 of Example 6 including the above configuration, the fixing sheet metal 12 and the upper fixing sheet metal 21 are fastened at positions nearer the damping rubbers 31 and 32 compared to Example 1, and are pushed by the elastic force of the damping rubbers 31 and 32. Thus, deformation of the rubber supporting faces 16*a* and 21*d* and fluctuation of their positions is suppressed.

EXAMPLE 7

Next, although Example 7 of the invention will be described, in the description of this Example 7, the same reference numerals will be given to constituent elements corresponding to the constituent elements of Examples 1 and 6, and detailed description thereof will be omitted.

Although this Example 7 is different from Examples 1 and 6 in respect of the following points, Example 7 is configured similarly to Examples 1 and 6 in other points.

In FIG. 15B, as for photoreceptor cleaner CL1 of Example 7, the position where the fixing sheet metal 12 and the upper fixing sheet metal 21 are fastened with the fastening screws 22 is set to the positions of the damping rubbers 31 and 32 unlike Examples 1 and 6. That is, the fixing sheet metal 12 and the upper fixing sheet metal 21 are fastened with the fastening screws 22 that pass through through-holes 31*a*, 32*a*, and 26*f* formed in the damping rubbers 31 and 32 and the blade sheet metal 26.

(Operation of Example 7)

In the photoreceptor cleaner CL1 of Example 7 including the above configuration, the fastening screws 22 fasten the fixing sheet metal 12 and the upper fixing sheet metal 21 at the positions of damping rubber 31 and 32. Thus, even if the fixing sheet metal 12 and 21 tend to be deformed by the elastic forces of the damping rubbers 31 and 32, the fastening screws 22 enable regulation of the deformation. Accordingly, fluctuation or distortion of the position of the blade sheet metal 26 is reduced.

EXAMPLE 8

Next, although Example 8 of the invention will be described, in the description of this Example 8, the same reference numerals will be given to constituent elements corresponding to the constituent elements of Examples 1 and 7, and detailed description thereof will be omitted.

Although this Example 8 is different from Examples 1 and 7 in respect of the following points, Example 8 is configured similarly to Examples 1 and 7 in other points.

In FIG. 15C, as for the photoreceptor cleaner CL1 of Example 8, the position where the fixing sheet metals are fastened with the fastening screws 22 is set to the positions of the damping rubbers 31 and 32 similarly to Example 7. Also, in Example 8, the fixed plate 13 and the connecting portion 14 of the fixing sheet metal 12 of Examples 1 and 7 are omitted. Thus, only the downward facing plate 16 is arranged, and the upper fixing sheet metal 21 is fixed to and supported by the container upper wall 11.

(Operation of Example 8)

In the photoreceptor cleaner CL1 of Example 8 including the above configuration, similarly to Example 7, the fastening screws 22 suppress deformation even if the downward facing plate 16 and the upper fixing sheet metal 21 tend to be deformed by the elastic forces of the damping rubbers 31 and 32, and positional fluctuation or distortion of the blade sheet metal 26 is reduced. Additionally, compared to Examples 1 and 7, the fixed plate 13 and the connecting portion 14 are omitted, and weight reduction is achieved as a whole.

EXAMPLE 9

Next, although Example 9 of the invention will be described, in the description of this Example 9, the same reference numerals will be given to constituent elements corresponding to the constituent elements of Examples 1 and 7, and detailed description thereof will be omitted.

Although this Example 9 is different from Examples 1 and 7 in respect of the following points, Example 9 is configured similarly to Examples 1 and 7 in other points.

In FIG. 15D, as for the photoreceptor cleaner CL1 of Example 9, the position where the fixing sheet metals are fastened with the fastening screws 22 is set to the positions of the damping rubbers 31 and 32 similarly to Example 7. Also, in Example 9, the upper fixing sheet metal 46 has a configuration in which the upper fixing sheet metal is short only near the second damping rubber 32 compared to Examples 1 and 7.

(Operation of Example 9)

In the photoreceptor cleaner CL1 of Example 9 including the above configuration, similarly to Example 7, the fastening screws 22 suppress deformation even if the downward facing plate 16 and the upper fixing sheet metal 21 tend to be deformed by the elastic forces of the damping rubbers 31 and 32, positional fluctuation or distortion of the blade sheet metal 26 is reduced, and a shortened upper fixing sheet metal 46 is adopted and reduced in weight.

(Modifications)

Although the examples of the invention have been described in detail, the invention is not limited to the above examples, but various modifications can be made thereto within the concept of the invention set forth in the claims. Modifications (H01) to (H010) of the invention are illustrated below.

(H01) Although the image forming apparatus U has been illustrated in the above examples, the invention is not limited thereto, and can be applied to a copying machine, a FAX, or a multi-purpose machine including these plural functions. Additionally, the invention is not limited to a single-color, so-called monochromatic image forming apparatus, and can also be applied to a multicolor, so-called polychromatic image forming apparatus.

(H02) Although the configuration in which the surface of the photoreceptor PR is cleaned by the cleaner CL1 has been illustrated as the cleaner CL1 serving as an example of a cleaner in the above examples, the invention is not limited thereto, and can also be applied to a cleaner of the transfer roller TR or a cleaner of the charging roller CR. In addition, in the color image forming apparatus, the invention can also be applied to a cleaner that performs cleaning of a belt-shaped or drum-shaped intermediate transfer body.

(H03) Although the configuration in which the three damping rubbers 31 or 32 are arranged at intervals in the front-and-rear direction has been illustrated in the above examples, the invention is not limited thereto. For example, the damping rubbers can also be one, two, or four or more, and the positions of the damping rubbers in the front-and-rear direction can be changed to arbitrary positions according to design, specification, or the like.

(H04) In the above examples, the shape of the shim 41 is not limited to the wedge-shaped shape, and can be arbitrarily changed. For example, the shape of the shim can also be a trapezoidal shape. Additionally, as for the number of shims 41, it is also possible to adjust the position or angle, for example, by combining plural wedge-shaped shims and plate-shaped shims.

(H05) In the above examples, the fixing sheet metal 12 and 21 and the curved portion 26*c* are enabled to have different rigidities. For example, the curved portion 26*c* and fixing sheet metals 12 and 21 may be made of the same metallic material and the thickness of the curved portion 26*c* may be made greater than that of the fixed sheet metals so as to increase rigidity. It is thereby possible to adopt a configuration in which the fixing sheet metal 12 and 21 is deformed earlier than the curved portion 26*c* and distortion of the blade sheet metal 26 is reduced, in a case where the elastic forces of the damping rubbers 31 and 32 have acted.

(H06) It is also possible to combine any or plural ones of the above Examples 1 to 9. For example, it is also possible to apply a configuration of Examples 4 and 5 to a configuration of Examples 6 to 9.

(H07) In the above examples, the shape of the fixing sheet metals 12 and 21 is not limited to a crank shape or a plate shape, and the material or shape of the fixing sheet metals can also be changed according to design or usage.

(H08) Although the configuration of the cleaning container 1 in which the main body 6 of the container and the container upper wall 11 are separate has been illustrated in the above examples, the invention is not limited thereto, and can also adopt a configuration in which the main body 6 of the container and the container upper wall 11 are integrated.

(H09) Although the configuration in which the blade sheet metal 26 is bent in an L-shape has been illustrated in the above examples, the invention is not limited thereto. The shape of the blade sheet metal can be changed to arbitrary shapes, such as a flat plate shape and a crank shape, according to design, specification, or the like.

(H010) although the configuration in which the damping body is arranged at the positions of damping rubber 31 and 32 has been illustrated in the above examples, the invention is not limited thereto. For example, arbitrary changes, such as adding the damping body between the left end of the curved portion 26*c* and the connecting portion 14 can be made.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. A cleaner comprising:

a plate-shaped cleaning member that includes a tip portion that comes into contact with an image carrier that carries an image on a surface thereof, and that removes and cleans developer adhered to the surface of the image carrier;

a cleaning container which stores the developer removed by the cleaning member;

a cleaning support that includes a cleaning supporting portion that supports a proximal end of the cleaning member, and a plate-shaped damped portion;

a damping unit that includes a first damping body arranged in contact with one face of the plate-shaped damped portion, and a second damping body arranged in contact with the other face of the plate-shaped damped portion and that regulates vibration of the cleaning support; and a fixing member of the damping unit that includes a first fixing portion arranged to face one face of the plate-shaped damped portion with the first damping body interposed therebetween, and a second fixing portion arranged to face the other face of the plate-shaped damped portion with the second damping body interposed therebetween, and that is supported by the cleaning container, wherein the first fixing portion contacts one of the first and second damping body and the second fixing portion contacts the other of the first and second damping body.

2. The cleaner according to claim 1, wherein the cleaning support includes:

the cleaning supporting portion that is formed in the shape of a plate that extends along a direction from the tip portion of the cleaning member to the proximal end thereof, the damped portion that extends in a direction curved with respect to a direction in which the cleaning supporting portion extends, and a supported portion that is provided at the cleaning supporting portion and supported by the cleaning container.

3. The cleaner according to claim 1, further comprising:

an angle-adjusting member inserted between the damping body and the fixing member of the damping body according to a preset angle of contact between the cleaning member and the image carrier.

4. The cleaner according to claim 1, wherein a portion of the fixing member of the damping body that comes into contact with the damping body is inclined with respect to a portion supported by the cleaning container according to a preset angle of contact between the cleaning member and the image carrier.

5. The cleaner according to claim 1, wherein the fixing member of the damping body includes a bent portion that is formed to be bent with respect to the portion that comes into contact with the damping body to improve rigidity.

6. An image forming apparatus comprising:

an image carrier that carries an image on a surface thereof;

a developing device that develops a latent image on the surface of the image carrier as a visible image;

a transfer unit that transfers the visible image developed by the developing device to a medium;

the cleaner according to claim 1 that removes and cleans developer adhered to the surface of the image carrier after the visible image has been transferred; and a fixing device that fixes the visible image transferred to the medium.

7. The cleaner according to claim 1, wherein the damping unit comprises at least two damping bodies.

8. The cleaner according to claim 1, wherein the first fixing portion and the second fixing portion are fixed to the cleaning container.

9. A cleaning apparatus for installing to a frame comprising:

a cleaning member that includes one end portion that comes into contact to a surface to be cleaned;

a support member that supports around the another end portion of the cleaning member, the support member including a first surface and a second surface; and a first damping member positioned on the first surface and a second damping member positioned on the second surface, the first and second damping members being configured so that the first and second damping members are placed between two inner surfaces the frame, wherein one of the two inner surfaces of the frame contacts one of the first and second damping members and the other of the two inner surfaces of the frame contacts the other of the first and second damping members.

* * * * *